US007497427B2

(12) United States Patent
Ogushi et al.

(10) Patent No.: US 7,497,427 B2
(45) Date of Patent: Mar. 3, 2009

(54) IMAGE FORMING APPARATUS

(75) Inventors: Takehiro Ogushi, Hachioji (JP); Tetsuo Hirata, Hachioji (JP); Motoki Nakamichi, Hachioji (JP); Norishige Kato, Hachioji (JP); Yasushi Saitsu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 173 days.

(21) Appl. No.: 11/424,344

(22) Filed: Jun. 15, 2006

(65) Prior Publication Data

US 2007/0048056 A1 Mar. 1, 2007

(30) Foreign Application Priority Data

Aug. 26, 2005 (JP) ..... 2005-245693

(51) Int. Cl.
*B65H 37/04* (2006.01)

(52) U.S. Cl. ..... 270/58.09; 270/37; 270/52.06; 270/58.02

(58) Field of Classification Search ..... 270/37, 270/52.06, 58.02, 58.09
See application file for complete search history.

(56) References Cited

U.S. PATENT DOCUMENTS

| | | | | |
|---|---|---|---|---|
| 6,145,825 | A * | 11/2000 | Kunihiro et al. | 270/58.09 |
| 6,595,509 | B2 * | 7/2003 | Sesek | 270/58.09 |
| 6,727,999 | B1 * | 4/2004 | Takahashi | 358/1.15 |
| 7,236,737 | B2 * | 6/2007 | Mochizuki | 399/410 |
| 2001/0016124 | A1 * | 8/2001 | Shiramura | 399/82 |
| 2005/0073082 | A1 * | 4/2005 | Wakabayashi et al. | 270/37 |
| 2005/0152725 | A1 * | 7/2005 | Mochizuki | 399/410 |

FOREIGN PATENT DOCUMENTS

JP 2003-341911 A 12/2003

* cited by examiner

*Primary Examiner*—Gene Crawford
*Assistant Examiner*—Leslie A Nicholson, III
(74) *Attorney, Agent, or Firm*—Frishauf, Holtz, Goodman & Chick, P.C.

(57) ABSTRACT

When a job cancellation instruction has been specified, if the number of the recording sheets loaded on the stacker device of a post-processing apparatus is not greater than the predetermined number of sheets, the aforementioned recording sheets are ejected without being subjected to the process of stapling and if it is greater than the predetermined number of sheets, the recording sheets having been stapled are ejected.

17 Claims, 7 Drawing Sheets

IMAGE FORMING APPARATUS

This application is based on Japanese Patent Application No. 2005-245693 filed on Aug. 26, 2005 in Japanese Patent Office, the entire content of which is hereby incorporated by reference.

BACKGROUND OF THE INVENTION

The present invention relates to an image forming system.

An image forming apparatus system has been proposed, wherein the image forming apparatus is provided with a post-processing apparatus for post-processing a recording sheet with an image having been formed thereon by an image forming apparatus.

For example, a recording sheet processing apparatus mounted on an image forming apparatus as an image forming system may be provided with a recording sheet ejection apparatus that aligns the ends of a plurality of recording sheets with an image formed thereon by an image forming apparatus and provides a post-processing such as stapling and then ejects the sheets. In such a recording sheet processing apparatus, a device for aligning a recording sheet bundle, a device for binding a recording sheet bundle, a device for ejection of recording sheets and others have been controlled such that when a recording sheet handling error such as a jam has occurred in the image forming apparatus, the bundle of recording sheets has to be ejected immediately without being post-processed and the job has to be suspended due to the difficultly of job recovery. After recovery of the error, the job is resumed from the beginning.

In recent years, an image forming apparatus provided with the following functions has been proposed (e.g. in Patent Document 1). The apparatus is controlled so that when information notifying that a recording sheet is placed in an abnormal state has been received, the recording sheet is loaded on a processed recording sheet stacking device and the current job is suspended. In response to the job cancellation information, the recording sheet conveyance device is controlled in such a way that the recording sheet located on the processed recording sheet stacking device is ejected without being processed. Upon receipt of information of resuming the operation, the recording sheet processing device and recording sheet conveyance device are controlled in such a way that the recording sheet loaded on the recording sheet stacking device is processed and ejected. This arrangement is intended to eliminate the wasteful consumption of the recording sheet, thereby improving the productivity and usability.

However, if the job is suspended during the production of a saddle stitched booklet as a post-processing of the recording sheet, the job will be suspended with the recording sheet being loaded on the stacking device. When job cancellation information has been received, a bundle of recording sheets are ejected without being bound by stapling. If the sheets are not bound by stapling, there is an upper limit to the number of recording sheet to be fed as a bundle. When the number of the recording sheets has exceeded the upper limit, the user has to open the door of the post-processing apparatus to take out the bundle of recording sheets.

[Patent Document 1] Unexamined Japanese Patent Application Publication No. 2003-341911

SUMMARY

An object of the present invention is to provide a post-processing apparatus capable of automatically ejecting the bundle of recording sheets when the job has been cancelled during the production of a saddle stitched booklet as a processing of recording sheets, wherein there is no need for a user to open the door of the post-processing apparatus to take out the bundle of recording sheets.

An object of the present invention can be achieved by the following structures:

(1) An image forming system including: an image forming apparatus for forming an image on a recording sheet, the image forming apparatus having an operation unit for inputting operation instructions; and a post-processing apparatus for post-processing the recording sheet with an image formed thereon by the aforementioned image forming apparatus; wherein the aforementioned post-processing apparatus includes: a stacker unit for loading the recording sheets with an image formed thereon; a stapling unit for applying a process of stapling to the bundle of recording sheets loaded on the aforementioned stacker unit; an ejection unit for ejecting the aforementioned the bundle of recording sheets; and a control unit capable of executing the stapling ejection mode; wherein, in the stapling ejection mode, when job cancellation instruction has been given from the aforementioned operation unit and the number of the recording sheets loaded on the aforementioned stacker unit is greater than a preset number, a process of stapling is applied to the aforementioned recording sheets and the sheets are ejected.

(2) A post-processing apparatus for applying a post-processing to the recording sheet with an image formed thereon by an image forming apparatus, the aforementioned post-processing apparatus including: a stacker unit for loading the recording sheet having been fed from the aforementioned image forming apparatus; a stapling unit for applying a process of stapling to the bundle of recording sheets loaded on the aforementioned stacker unit; and an ejection unit for ejecting the aforementioned the bundle of recording sheets; wherein the aforementioned post-processing apparatus is capable of executing the stapling ejection mode in which, when job cancellation instruction has been received from the aforementioned image forming apparatus and the number of the recording sheets loaded on the aforementioned stacker unit is greater than the preset number, the aforementioned post-processing apparatus executes a process of stapling and ejects the sheets.

DETAILED DESCRIPTION OF THE PREFERRED EMBODIMENT

The following describes the embodiments of the present invention with reference to drawings.

Figure 1:
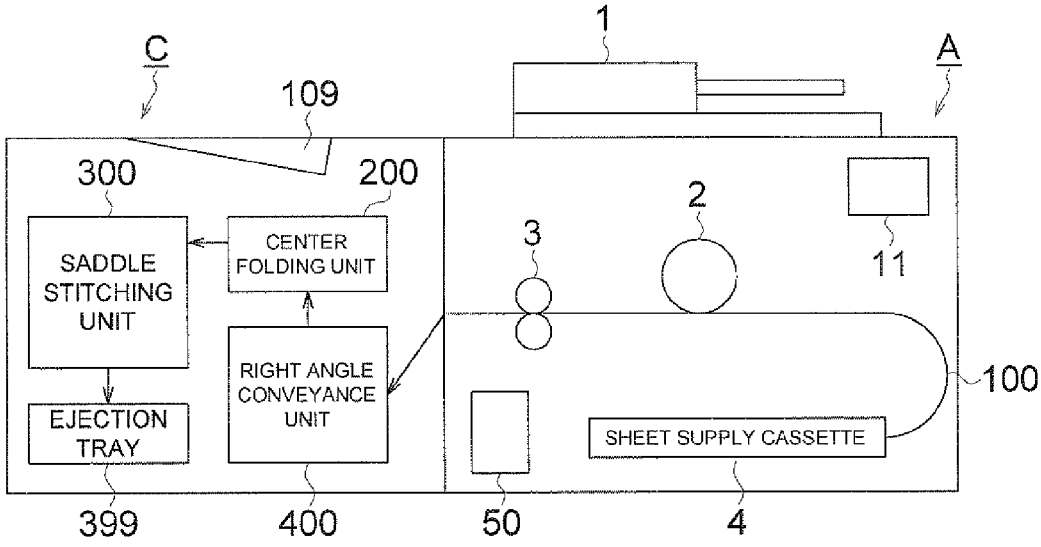
FIG. 1 is a schematic diagram representing the overview of an image forming system in an embodiment of the present invention.

FIG. 1 is a schematic diagram representing the overview of an image forming system of the present invention.

FIG. 1 is a conceptual view of a saddle stitching apparatus C as a post-processing apparatus of the present invention connected to the objection unit of the image forming apparatus A. The saddle stitching apparatus C is connected to the image forming apparatus A in this form. The orientation of the recording sheets with an image formed thereon by the image forming apparatus A are changed at the right angle conveyance unit 400 by the saddle stitching apparatus C. After having been subjected to processing of center folding and saddle stitching, the recording sheets are formed into a booklet and are ejected into the ejection tray 399 arranged on the front side Cf of the saddle stitching apparatus C. The recording sheets that need not be subjected to saddle stitching are ejected to the sub-ejection tray (too tray) 109 of the saddle stitching apparatus C.

The following describes the details.

Image Forming Apparatus

The image forming apparatus A illustrated in the drawing is made up of an image reading unit 1, image forming unit 2, fixing unit 3, sheet supply cassette 4, recording sheet conveying unit 100, operation unit 11, control unit 50 and others.

The image reading unit 1 uses a CCD sensor and others for photoelectric conversion of documents. The analog-to-digital converted image data are sent to the image forming unit 2.

The image forming unit 2 converts the image data into a light beam using a laser and others. The light beam is applied to an image carrier so that the image carrier is electrically charged to form a latent image. Then a process of development is applied thereto so that a toner image is developed. The toner image is transferred onto the recording sheet S having been conveyed by the recording sheet conveying unit 100.

The fixing unit 3 applies heat and pressure to the recording sheet S with the toner image transferred thereon, utilizing the heat roller and pressure roller arranged face to face with each other, whereby the toner image is fixed onto the sheet.

The sheet supply cassette 4 is loaded with the recording sheets S. An image is formed on the recording sheets S taken out one by one, and the recording sheets are then fed to the saddle stitching apparatus C as a post-processing apparatus via the recording sheets conveying unit 100.

The operation unit 11 includes a display device as an LCD and buttons for inputting data. The operation unit 11 is used to input the instructions to be specified by the user, for example, whether saddle stitching is performed or not, the size of the recording sheets to be outputted, the number of recording sheets of a booklet subjected to the process of saddle stitching, and the number of booklets to be formed. The operation unit 11 is also used to input the instruction to cancel the job.

In response to the job requirements, the control unit 50 controls the operations of the image forming apparatus A and saddle stitching apparatus C. When the data of the job specified by the user has been inputted through the operation unit 11, the operations of various units of the image forming apparatus A are controlled according to the inputted job requirements, whereby an image is formed. The recording sheets carrying the image having been formed thereon are conveyed to the saddle stitching apparatus C as a post-processing apparatus. Further, the control unit 50 controls the operations of the saddle stitching apparatus C and executes the process of saddle stitching.

Saddle Stitching Apparatus

Figure 2:
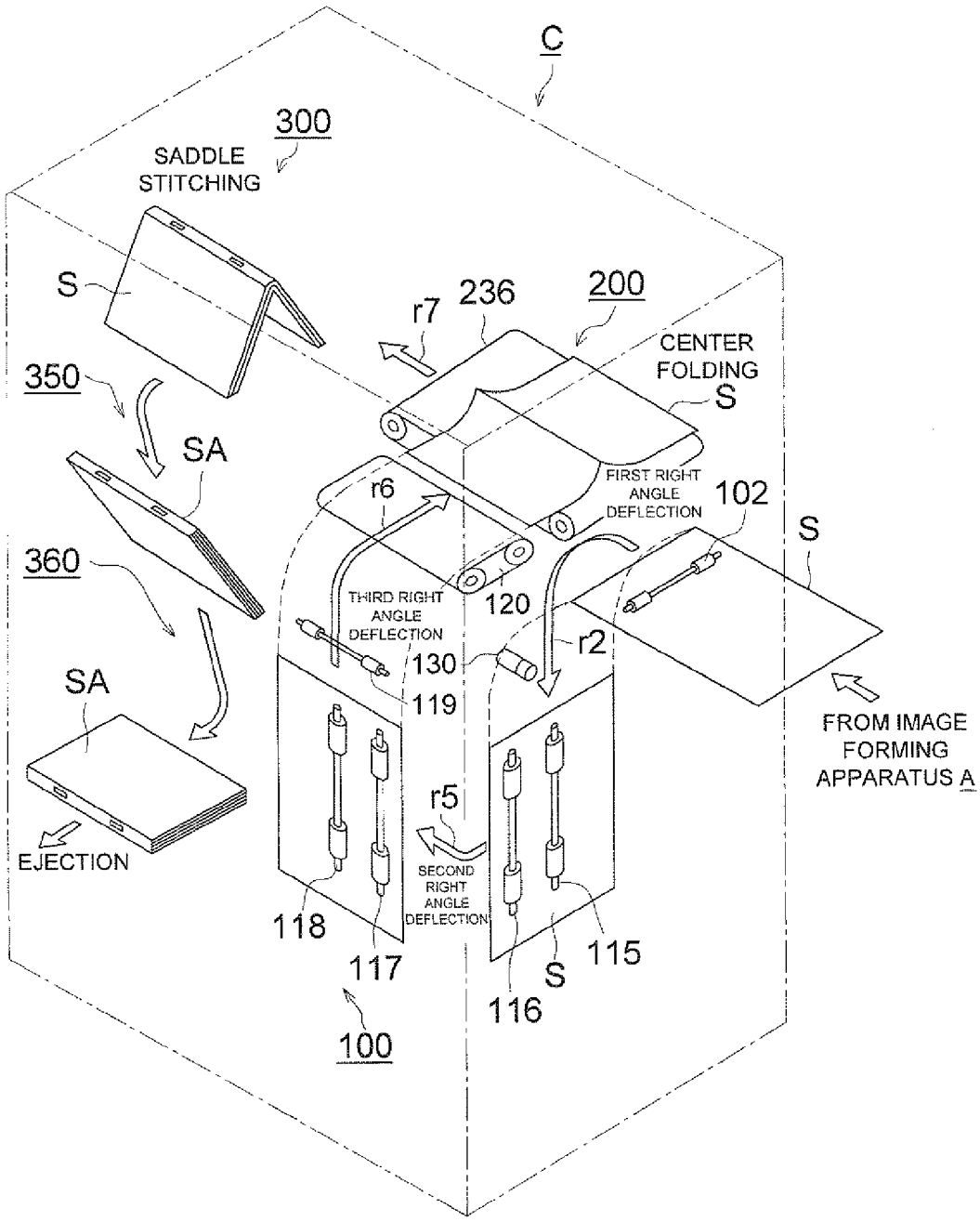
FIG. 2 is a schematic diagram showing a series of processes wherein recording sheets S are formed into a booklet through center folding and saddle stitching in a saddle stitching apparatus C of an embodiment of the present invention.

FIG. 2 is a schematic diagram showing a series of processes wherein recording sheets S are formed into a booklet through center folding and saddle stitching processes in a saddle stitching apparatus C relating to the present invention. As shown in FIG. 2, the recording sheets S having been conveyed from the image forming apparatus A to the saddle stitching apparatus C are conveyed to the right angle conveyance unit 400, center folding unit 200 and saddle stitching unit 300 by the recording sheet conveying unit 100. These recording sheets S are subjected to center folding and saddle stitching, and are formed into a booklet SA and then ejected to the ejection tray 399 as an ejection unit. The recording sheets conveying unit 100 is formed of a plurality of conveyor rollers, conveyor belts and guides. A first right angle deflection unit, a second right angle deflection unit and a third right angle deflection unit for changing the recording sheet conveying direction by 90 degrees are arranged at some midpoints along the path where the recording sheets are fed. Further, the booklets subsequent to the process of saddle stitching are conveyed by a booklet conveyance device 350. Before being ejected, the booklets are pressed against the folding portion by a booklet pressing device 360 so that a bulge is removed.

Such a series of the operations of the saddle stitching apparatus C, from the start to the end as described above, is controlled by a control unit 50. The following describes the details of the operation.

Figure 3:
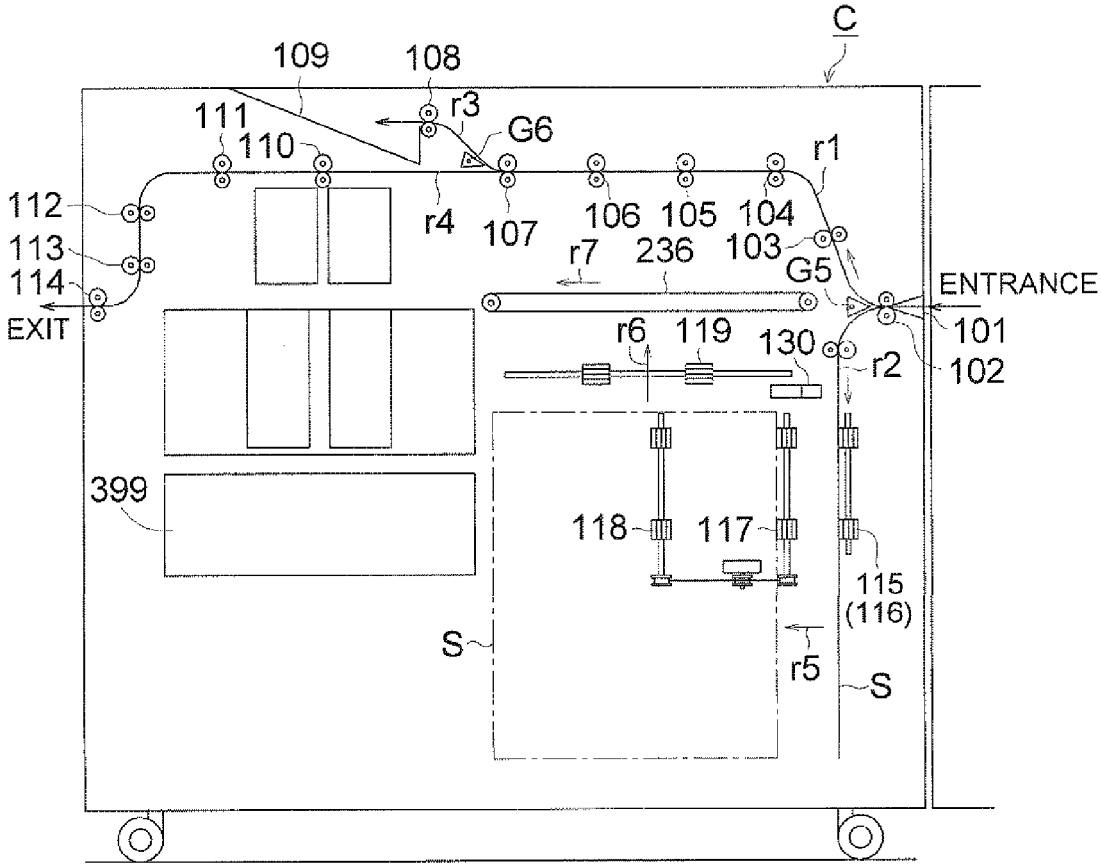
FIG. 3 is a front view of the saddle stitching apparatus C in an embodiment of the present invention.
Figure 4:
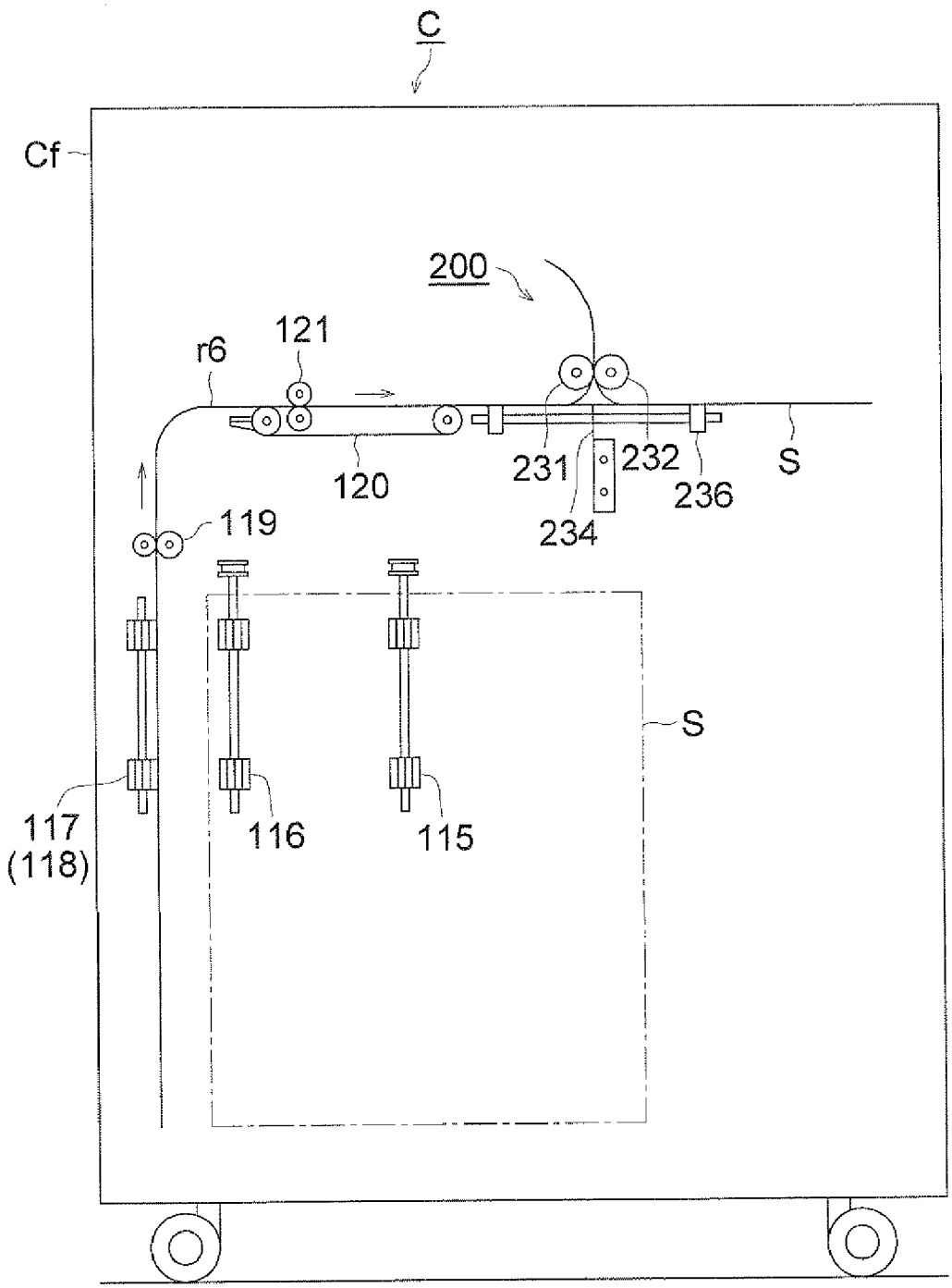
FIG. 4 is a left side view of the saddle stitching apparatus C in an embodiment of the present invention.
Figure 5:
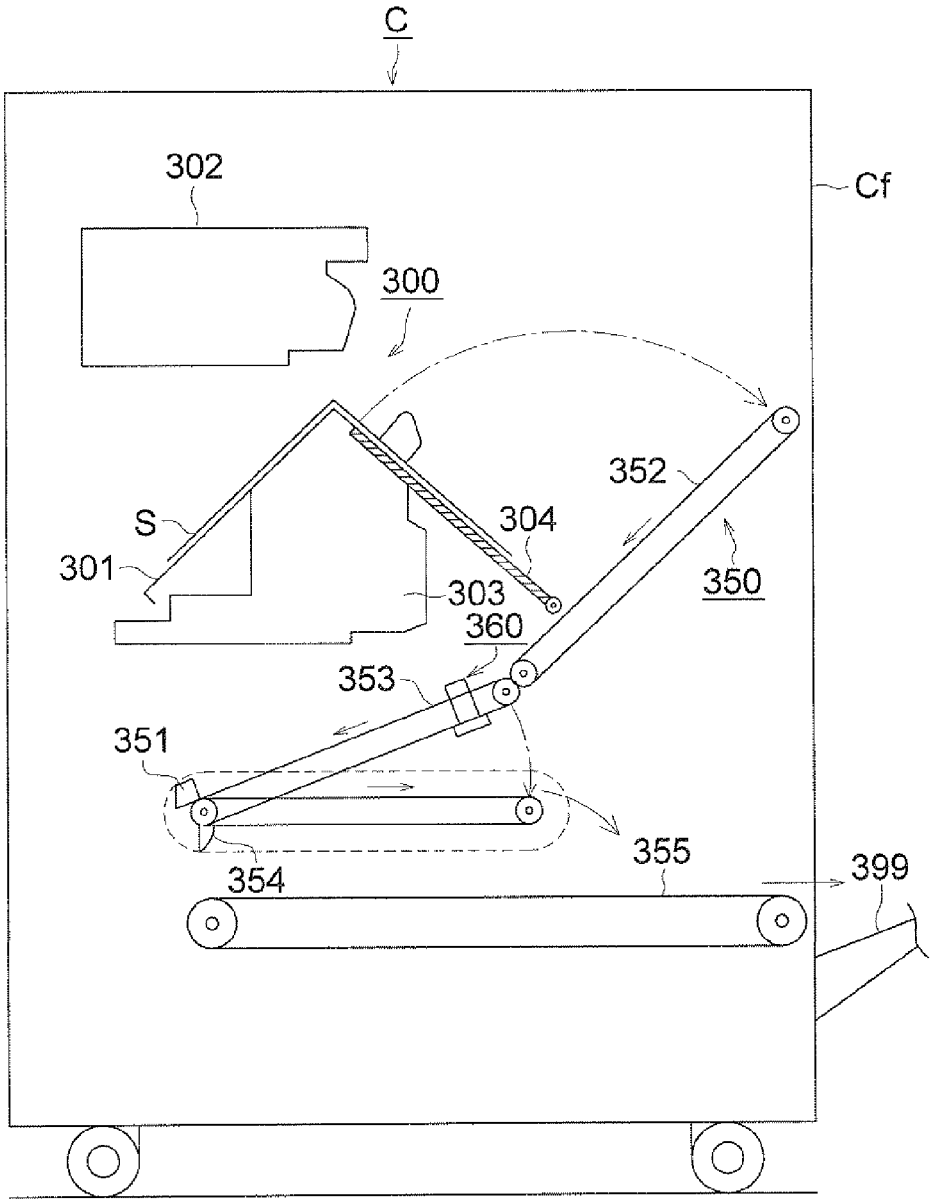
FIG. 5 is a right side view of the saddle stitching apparatus C in an embodiment of the present invention.

FIG. 3 is a front view of the saddle stitching apparatus C, FIG. 4 is a left side view thereof, and FIG. 5 is a right side view thereof.

As shown in FIG. 3, the recording sheet S having been ejected from the image forming apparatus A and introduced to the entrance (saddle stitching entrance) 101 of the saddle stitching apparatus C is sandwiched by the entrance rollers 102, and is fed to either the conveyance path r1 upward from the conveyance-path switching device G5 or conveyance path r2 downward therefrom.

The recording sheet S fed along the conveyance path r1 is gripped and conveyed by the conveyor roller 103 through 107, and is fed to either the conveyance path r3 upward from the conveyance-path switching device G6 or the conveyance path r4 downward therefrom.

The recording sheets that do not require saddle stitching go to the upward conveyance path r3, and are ejected by the ejection roller 108. They are then loaded on the sub-ejection tray (top tray) 109 as a saddle stitching ejection unit arranged on the upper portion of the saddle stitching apparatus C. The downward conveyance path r4 is a conveyance path for loading the recording sheets into another post-processing apparatus. The recording sheets having reached the conveyance path r4 are gripped and fed by the conveyor rollers 110 through 113. They are ejected by the ejection rollers 114 of the saddle stitching ejection unit and are led into another post-processing apparatus connected thereto.

First Right Angle Deflection Conveyance

The recording sheets subjected to saddle stitching are fed to the conveyance path r2 downward of the conveyance-path switching device G5, and the feed direction is changed to almost the vertical downward direction by a guiding device (not illustrated). The recording sheets are then fed to the first predetermined position shown by a one-dot chain line of FIG.

4. The conveyance path r2 is provided with a recording sheets sensor 130, which detects the passage of the recording sheets, and sends the detection information.

Second Right Angle Deflection Conveyance

The recording sheets S having reached the first predetermined position are deflected to the direction toward the near side at a right angle to the paper surface on which FIG. 3 is illustrated by the conveyor rollers 115 through 118 and a guide plate (not illustrated). The recording sheets pass through the conveyance path r5 loading to the front side Cf in the saddle stitching apparatus C, with the surface thereof kept in an upright position, and are fed to the second predetermined position shown by a one-dot chain line of FIG. 3.

<Third right angle deflection conveyance>

As shown in FIG. 4, the recording sheets S loaded in the second predetermined position are conveyed upward in the vertical direction by the conveyor rollers 119 and a guide member (not illustrated) in response to the instruction from the control unit 50, and are deflected in the horizontal direction. They are then moved to the rear side inside the saddle stitching apparatus C by the conveyor belt 120 and conveyor rollers 121 (conveyance path r6).

Center Folding Function

As shown in FIG. 4, a center folding unit 200 is arranged on the downstream side of the conveyor belt 120 in the recording sheet conveying direction. The center folding unit 200 is provided with folding rollers 231 and 232 end folding plate 234.

The recording sheets S having reached the center folding unit 200 are nipped by the folding rollers 231 and 232 rotating in the mutually reverse directions and a folding plate 234 traveling straight. They are folded across the width at the mid-point in the recording sheets conveying direction.

After that, the folding rollers 231 and 232 are rotated in the reverse direction. The recording sheets having been folded are set apart from the folding rollers 231 and 232, and are placed back to the original horizontal conveyance path. The recording sheets S are then fed to the conveyance path r7 in the direction as an extension of the fold shown in FIG. 3 by a conveyor belt 236, and are fed into the saddle stitching unit 300.

Saddle Stitching Function

The recording sheets S center-folded in the center folding unit 200 are fed in the direction of the conveyance path r7 by the conveyor belt and guiding device (not illustrated), and are placed on the saddle member 301 as the stacking unit of the saddle stitching unit 300 shown in FIG. 5. The upper portion of the saddle member 301 has a convex form with an angle of approximately 90 degrees. The center-folded recording sheets S are placed in such as way that the inside of the fold is located at a predetermined position on the ridge line of the top thereof. The recording sheets are fed sequentially and are placed on the saddle member 301 at every completion of center folding, wherein these recording sheets are such that the recording sheet S corresponding to the innermost page of the booklet forms the lowest surface, and one booklet is formed thereon. Above the saddle member 301, a stapling mechanism 302 is supported so that it can be moved in the vertical direction. A staple receiving mechanism 303 is fixed inside the saddle member 301. Two sets of stitching units of two-part structure each made up of the stapling mechanism 302 and staple receiving mechanism 303, namely, two sets of stapling devices are arranged in the direction of the fold line on the recording sheet. When the recording sheets for one booklet have been loaded on the saddle member 301, the stapling mechanism 302 moves downward to perform saddle stitching operation. In other words, two sets of stitching units drive staples at two positions apportioned at the center along the fold line of the bundle of recording sheets located on the saddle member 301. When the staples are driven along the fold line of the bundle of recording sheets located on the saddle member 301, the bundle of recording sheets are saddle-stitched and are formed into a booklet wherein the right and left pages are opened at an angle of approximately 90 degrees on the saddle member 301.

The booklet in the form of double-page spread is supported by a guide member 304 that can be swung. Swung in the direction marked by a chain line, the booklet is placed on the conveyor belt 352 of the booklet conveyance device 350. In this case, the booklet in the form of spread pages on both sides on the saddle member 301 is closed.

The booklet SA placed on the conveyor belt 352 is fed toward the lower side by rotation of the conveyor belt 352, and is transferred onto the conveyor belt 353 located on the slanted position. It is further fed by the rotating conveyor belt 353, and is stopped when the leading edge of the booklet has engaged with a booklet leading edge stopper 351 fixed to a booklet loading table (not illustrated).

After that, the conveyor belt 353 swings to be placed in the horizontal position. The folding portion of the booklet located on the conveyor belt 353 placed in the horizontal position is pressed by the booklet pressing device 360 to be described later. The booklet pressing device 360 continues to press the booklet under the control of the control unit for a predetermined period time or until the stapling process of succeeding booklet is performed. By the booklet pressing device 360 continuing to press the booklet for a predetermined period of time or until the stapling process of succeeding booklet is performed, a bulge is removed from the folding portion of the booklet.

After a predetermined period of time has elapsed or the stapling process of the succeeding booklet has been performed, the booklet pressing device 360 releases pressure and the booklet is conveyed by the sheet ejection claw 354 fixed on the reversing conveyor belt 353, with the trailing edge of the booklet being pressed. The booklet then falls from the end of the conveyor belt 353 in the arrow-marked direction. The booklet having fallen is ejected by the rotating conveyor belt 355 to the ejection tray 399 located outside the front side Cf of the saddle stitching apparatus C.

Figure 6:
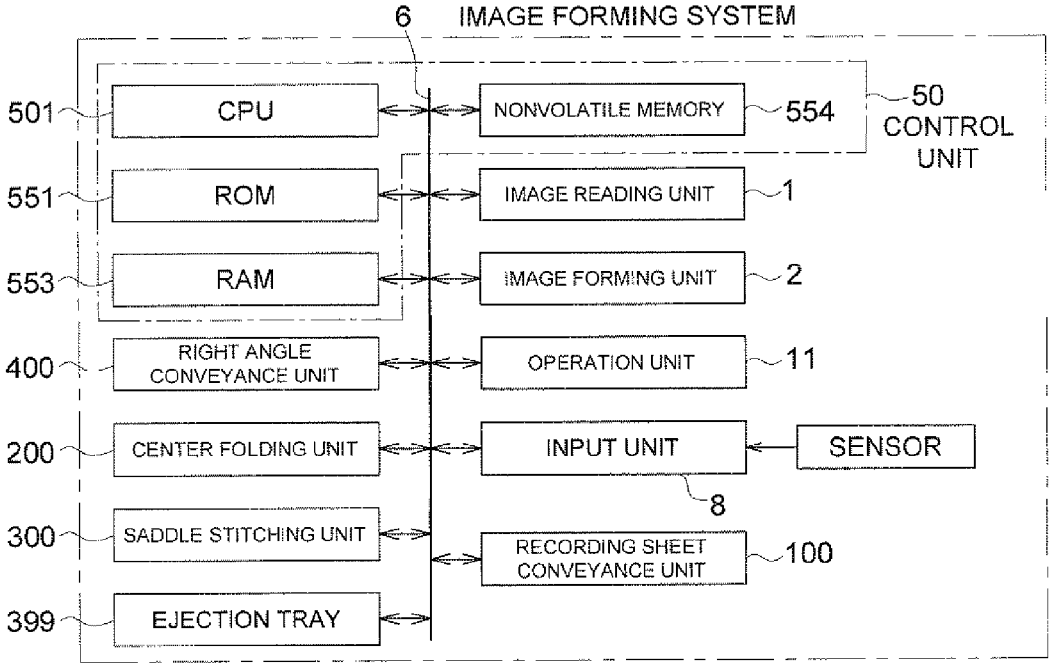
FIG. 6 is a block diagram showing the operation control of the image forming system in an embodiment of the present invention.

FIG. 6 is a block diagram showing the operation control of the image forming system of the present invention.

The control unit 50 is provided with a CPU 501, ROM 551, RAM 553 and nonvolatile memory 554. When the CPU 501 executes the program stored in advance in the ROM 551, an image reading unit 1, image forming unit 2 and other units connected to the bus 6 are placed under overall control.

Job information is inputted from the operation unit 11, wherein such job information includes whether each the center folding and saddle stitching is performed, the size of the recording sheets, the number of the sheets to be bound, the number of the booklets, the predetermined number of sheets relating to the present invention, whether a process of stapling is performed when the predetermined number has been exceeded, and the choice between one position or a plurality of positions to be stapled.

The input unit 8 detects the status of each sensor (e.g. recording sheets sensor 130), and sends the result to the control unit 50 through the bus 6.

The image reading unit 1, image forming unit 2, recording sheets conveying unit 100, right angle conveyance unit 400, center folding unit 200, saddle stitching unit 300 and ejection tray 399 have already been described, and will not be described to avoid duplication.

The following describes the processing of the recording sheet when job cancellation instruction has been designated.

For example, while the saddle member 301 of the saddle stitching unit 300 is being loaded with the recording sheets, if the sensor arranged on the recording sheet conveying unit 100 has detected a paper jam or a job cancellation instruction is given by the operator, the recording sheets conveying unit 100 temporarily suspends conveyance and a message appears on the operation unit 11 to make sure if the job should be cancelled or not. By contrast, when a job cancellation instruction has been specified by the user through the operation unit 11 in the final phase, if the number of recording sheets loaded on the saddle member 301 is greater than the preset predetermined number of sheets and the stapling ejection mode is turned off, a process of stapling is not applied to the bundle of recording sheets, and no recording sheet is ejected. The user then opens the saddle stitching apparatus C, and takes out the recording sheets loaded on the saddle member 301.

The predetermined number of sheets refers to the maximum number of the recording sheets that can be fed with no problems to the ejection tray without being subjected to stapling. In the present embodiment, it refers to the maximum number of the center-folded sheets without being subjected to saddle stitching which can be ejected without problems. The predetermined number of sheets can be set to an appropriate value based on the basis weight and the type of the recording sheet.

The predetermined number of sheets can be changed by the operation unit 11. The number of sheets to be stapled can be changed as desired, depending on the degree of conveyance failure, for example.

When the number of the loaded recording sheets is greater that the predetermined number of sheets and the stapling ejection mode is turned on, a process of stapling is performed and the recording sheets are sent to the ejection tray. In this case, the setting of the number of stapling positions is checked. If the number of stapling positions is set to 1, a process of stapling is applied to one position. If a plurality of positions are set as the stapling positions, a process of stapling is applied to a plurality of positions, and the recording sheets are then sent to the ejection tray. In the present embodiment, the number of stapling positions is two as shown by the saddle stitching unit 300 of FIG. 2. Therefore, if the number of stapling positions is one, a process of stapling is applied to one position. If the number of stapling positions is plural, a process of stapling is applied to two positions.

When the number of loaded sheets is not greater than the predetermined number, the recording sheets on the saddle member 301 are ejected to the ejection tray 399 without being subjected to saddle stitching.

According to the present embodiment, a control unit is provided to ensure that, when the stacker device is loaded with the recording sheets and a job cancellation instruction is specified from the operation unit, if the number of the recording sheets loaded on the stacker device is not greater than the predetermined number of sheets, the recording sheets are ejected without being subjected to stapling. The control unit also ensures that if it is greater than the predetermined number of sheets, the recording sheets are ejected after having been subjected to stapling. This arrangement eliminates the need for the user to open the door of the post-processing apparatus and to take out the loaded recording sheets, when there is a job cancellation instruction.

According to the present embodiment, if the number of the recording sheets is greater than the predetermined number of sheets, the control unit controls to perform a process of stapling or not to perform a process of stapling based on the information inputted from the operation unit. This arrangement saves the staples to be consumed. This arrangement also allows the use to take out the loaded recording sheets manually.

According to the present embodiment, if the number of the recording sheets is greater than the predetermined number of sheets, a process of stapling is applied to one or plural positions on the bundle of recording sheets under the control of the control unit, based on the information inputted from the operation unit. This arrangement saves the staples to be consumed.

Figure 7:
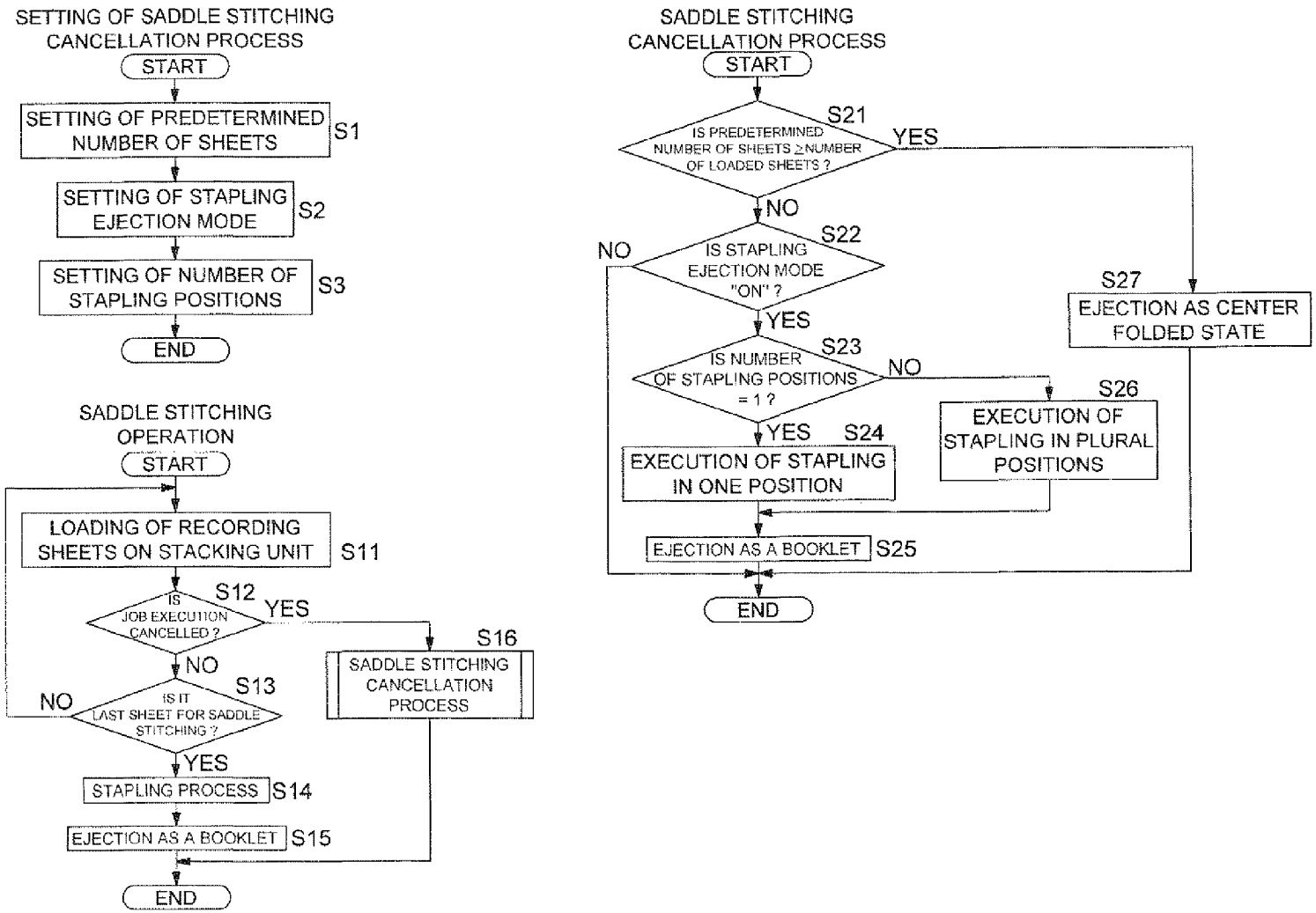
FIG. 7 is a flow chart showing the process of job cancellation instruction in an embodiment of the present invention.

FIG. 7 is a flow chart showing the process of job cancellation instruction in the present invention.

The process to be applied when the job has been cancelled is set from the operation unit 11 in the first place. In the Step S1, the predetermined number of sheets is inputted from the operation unit, and is set.

In the Step S2, the stapling ejection mode is set. When a process of stapling is applied to the recording sheet and the recording sheet is ejected, the mode is set to ON. The mode is set to OFF when the recording sheet is ejected without being subjected to stapling.

In the Step S3, the number of stapling positions is set. If it is one, the flag for the number of stapling positions is turned on. If it is more than one, the flag for the number of stapling positions is turned off.

In the Steps 1 through 3, the set data is stored in the nonvolatile memory and the setting remains unchanged until the next setting is made.

The following describes the flow of the process of saddle stitching. This routine starts when the recording sheets S center-folded in the center folding unit 200 have been sent to the saddle stitching unit 300.

In the Step S11, the recording sheets are loaded on the saddle member 301 as a stacking unit.

In the Step S12, a check is made to see if there is any job cancellation instruction. If there is any job cancellation instruction (Step S12: Yes), the system goes to the Step S16. If not (Step S12: No), the system goes to the Step S13.

In the Step S13, a check is made to see if the recording sheet is the last one or not in the booklet in the process of saddle stitching. If it is the last recording sheet (Step S13: Yes), the system goes to the Step S14. If not (Step S13: No), the system goes back to the Step S11.

In the Step S14, a process of stapling is applied.

In the Step S15, the booklet subjected to the process of stapling is ejected to the ejection tray.

In the Step S16, a process of saddle stitching cancellation is performed.

The following describes the saddle stitching cancellation subroutine:

In the Step S21, the predetermined number of sheets is compared with the number of sheets loaded on the saddle member 301. If the predetermined number of sheets is greater than the number of loaded sheets (Step S21: Yes), the system goes to the step S27. If not (Step S21: No), the system goes to the Step S22.

In the Step S22, a check is made to see if the stapling ejection mode is turned on or not. If this mode is turned on (Step S22: Yes), the system goes to the Step S23. If this mode is turned off (Step S22: No), the routine terminates. When the mode is off, the user opens the door of the post-processing apparatus (saddle stitching apparatus) and takes out the recording sheets loaded there.

In the Step S23, a check is made to see if the number of stapling positions is one or not. If it is one (Step S23: Yes), the system goes to the Step S24. If it is more than one (Step S23: No), the system goes to the Step S26.

In the Step S24, a process of stapling is applied to one position.

In the Step S25, the booklet having been stapled is fed to the ejection tray.

In the Step S26, a process of stapling is applied to more than one position.

In the Step S27, the center-folded recording sheets are fed to the ejection tray without being subjected to stapling.

The present embodiment refers to the case of saddle stitching wherein approximately the center of the bundle of sheets are bound. Without being restricted thereto, the present invention is applicable to the case where the peripheral portion of the bundle of sheets is bound.

What is claimed is:

1. An image forming system comprising:

an image forming apparatus for forming images on recording sheets, the image forming apparatus comprising an operation unit for inputting operation instructions, including a cancellation of job instruction; and a post-processing apparatus for conducting post-processing on the recording sheets on which the image forming apparatus has formed the images;

wherein the post-processing apparatus comprises:

a stacker for loading thereon the recording sheets on which the images have been formed;

a stapler for conducting a stapling process on the recording sheets loaded on the stacker;

an ejector for ejecting the recording sheets; and a controller which, when the cancellation of job instruction for a job which includes the stapling process is input via the operation unit and when a number of the recording sheets loaded on the stacker is greater than a preset number, executes a stapling ejection mode in which the recording sheets are subjected to the stapling process by the stapler and then ejected by the ejector.

2. The image forming system of claim 1, wherein when the cancellation of job instruction for the job which includes the stapling process is input via the operation unit and when the number of the recording sheets loaded on the stacker is not greater than the preset number, the controller executes an ejection mode in which the recording sheets are ejected without the stapling process.

3. The image forming system of claim 1, wherein the stapling ejection mode is settable from the operation unit.

4. The image forming system of claim 3, wherein when the stapling ejection mode is executed, the controller controls the stapler to carry out the stapling process in at least one position on the loaded recording sheets based on information inputted from the operation unit.

5. The image forming system of claim 1, wherein when the stapling ejection mode is executed, the controller controls the stapler to carry out the stapling process in at least one position on the loaded recording sheets based on information inputted from the operation unit.

6. The image forming system of claim 5, wherein when the stapling ejection mode is set to off and the cancellation of job instruction for the job which includes the stapling process is input via the operation unit, the ejector does not eject the recording sheets regardless of the number of the recording sheet loaded on the stacker.

7. The image forming system of claim 1, wherein the preset number is changeable.

8. The image forming system of claim 1, wherein the post-processing apparatus further comprises a folding unit for conducting a folding process on the loaded recording sheets.

9. The image forming system of claim 8, wherein the stapler conducts the stapling process after the folding process in the folding unit.

10. A post-processing apparatus for conducting post-processing on recording sheets on which an image forming apparatus has formed images, the post-processing apparatus comprising:

a stacker for loading thereon the recording sheets conveyed from the image forming apparatus;

a stapler for conducting a stapling process on the recording sheets loaded on the stacker;

an ejector for ejecting the recording sheets, wherein when a cancellation of job instruction for a job which includes the stapling process is input via the image forming apparatus and when a number of the recording sheets loaded on the stacker is greater than a preset number, the post-processing apparatus executes a stapling ejection mode in which the recording sheets are subjected to the stapling process by the stapler and then ejected by the ejector.

11. The post-processing apparatus of claim 10, wherein when the cancellation of job instruction for the job which includes the stapling process is input via the image forming apparatus and when the number of the recording sheets loaded on the stacker is not greater than the preset number, the post-processing apparatus executes an ejection mode in which the recording sheets are ejected without the stapling process.

12. The post-processing apparatus of claim 10, wherein when the stapling ejection mode is executed, the post-processing apparatus controls the stapler to carry out the stapling process in at least one position on the loaded recording sheets based on information inputted from the image forming apparatus.

13. The post-processing apparatus of claim 10, wherein the preset number is changeable.

14. The post-processing apparatus of claim 10, further comprising a folding unit for conducting a folding process on the loaded recording sheets.

15. The post-processing apparatus of claim 14, wherein the stapler conducts the stapling process after the folding process in the folding unit.

16. The post-processing apparatus of claim 10, wherein when the stapling ejection mode is set to off and the cancellation of job instruction for the job which includes the stapling process is input via the image forming apparatus, the ejector does not eject the recording sheets regardless of the number of the recording sheets loaded on the stacker.

17. An image forming system comprising:

image forming means for forming images on recording sheets, the image forming means comprising an operating means for inputting operation instructions, including a cancellation of job instruction; and post-processing means for conducting post-processing on the recording sheets on which the image forming means has formed the images;

wherein the post-processing means comprises:

stacking means for loading thereon the recording sheets on which the images have been formed;

stapling means for conducting a stapling process on the recording sheets loaded on the stacking means;

ejecting means for ejecting the recording sheets; and controlling means for, when the cancellation of job instruction for a job which includes the stapling process is input via the operating means and when a number of the recording sheets loaded on the stacking means is greater than a preset number, executing a stapling ejection mode in which the recording sheets are subjected to the stapling process by the stapling means and then ejected by the ejecting means.

* * * * *